US005529050A

United States Patent [19]

D'Andrade

[11] Patent Number: 5,529,050

[45] Date of Patent: Jun. 25, 1996

[54] SAFETY NOZZLE FOR PROJECTILE SHOOTING AIR GUN

[76] Inventor: Bruce M. D'Andrade, 3 Ten Eyck Rd., Whitehouse Station, N.J. 08889

[21] Appl. No.: 258,419

[22] Filed: Jun. 10, 1994

[51] Int. Cl.[6] ..... F41B 11/00

[52] U.S. Cl. ..... 124/56; 124/73; 124/1

[58] Field of Search ..... 124/56, 69, 66, 124/67, 68, 58, 83, 84, 71, 72, 73, 74, 76, 1

[56] References Cited

U.S. PATENT DOCUMENTS

| | | | |
|---|---|---|---|
| 1,488,995 | 4/1924 | McCollom . | |
| 1,575,644 | 3/1926 | Schmidt . | |
| 2,011,749 | 8/1935 | Brading . | |
| 2,237,678 | 4/1941 | Lohr et al. . | |
| 2,818,056 | 12/1957 | Martin . | |
| 3,859,977 | 1/1975 | Lange | 124/66 |
| 3,913,553 | 10/1975 | Braughler et al. | 124/73 |
| 4,212,285 | 7/1980 | Cagan et al. | 124/67 |
| 4,644,930 | 2/1987 | Mainhardt | 124/58 |
| 4,732,136 | 3/1988 | Ferri . | |
| 4,735,239 | 4/1988 | Salmon et al. . | |
| 4,848,307 | 7/1989 | Tsao | 124/67 X |
| 4,854,480 | 8/1989 | Shindo . | |
| 4,892,081 | 1/1990 | Moormann . | |
| 5,186,156 | 2/1993 | Clayton | 124/67 X |
| 5,373,832 | 12/1994 | D'Andrade | 124/73 X |
| 5,373,833 | 12/1994 | D'Andrade | 124/73 X |
| 5,396,877 | 3/1995 | Amron | 124/58 |

*Primary Examiner*—Kenneth J. Dorner
*Assistant Examiner*—Harry C. Kim
*Attorney, Agent, or Firm*—Kenneth P. Glynn

[57] ABSTRACT

The present invention relates to a safety mechanism for an air gun having a nozzle with an inlet and an outlet and having pressurization capabilities and a release for releasing pressure through the nozzle, wherein the nozzle includes an impediment member (e.g. a launch tube) with which a mating projectile is fitted for shooting. The safety mechanism is located within the nozzle at the nozzle inlet, and prevents or inhibits shooting undesirable projectiles. The safety mechanism includes a valve connected to the nozzle to prevent flow of pressurized air into it when closed and to allow flow of pressurized air when opened; a biasing device for biasing the valve to a closed position; an opening device movably located within nozzle, e.g. within an annular space between a launch tube and the nozzle. This has a first position when a projectile is not located in the nozzle, corresponding to the valve being closed, and has a second position when a projectile is located in the nozzle, corresponding to the valve being opened. When the opening device is moved from its first position to its second position, the valve is moved from its closed position to its open position to permit the shooting of a projectile. The impediment member impedes the insertion and shooting of a non-mating object.

20 Claims, 2 Drawing Sheets

SAFETY NOZZLE FOR PROJECTILE SHOOTING AIR GUN

BACKGROUND OF THE INVENTION

1. Field of the Invention

The present invention is directed to air pressurized toy guns for launching projectiles. More specifically, the present invention relates to a safety mechanism for nozzles of such air pressurized to guns to reduce the chances of dangerous objects being shot therefrom while automatically permitting the shooting of hollow projectiles, e.g. soft darts, therefrom.

2. Information Disclosure Statement

Air guns have been available for decades and typically rely upon a reciprocal hand pump to compress air in a chamber for subsequent firing. These are often used for firing BB's or pellets. Other gas powered guns rely upon canisters of compressed gas wherein the gas is released for firing. Toy guns which involve the use of bladders have been developed for storing and shooting water.

The following patents are representative of toy guns, illustrating in chronological order toy guns which shoot projectiles and/or are otherwise pressurized:

U.S. Pat. No. 1,488,995 issued to Edwin McCollom describes a projectile shooting toy gun which relies upon a spring loaded, u-shaped rod which is cocked by pulling and released by a trigger release.

U.S. Pat. No. 2,011,749 to Harry Brading describes a dart game which uses a blow pipe for launching the darts.

U.S. Pat. No. 1,575,644 to William Schmidt describes a pistol which fires a projectile and relies upon a compression spring to compress air and to thereby actuate the firing of the projectile.

U.S. Pat. No. 2,237,678 issued to Raymond Lohr et al describes a repeating, cork shooting toy which utilizes a cork magazine which rotates after each firing to position the next cork in sequence for firing.

U.S. Pat. No. 2,818,056 to Robert Martin describes a compressed gas-operated propelling mechanism in a toy gun.

U.S. Pat. No. 4,732,136 issued to Giampiero Ferri sets forth a toy gun which relies upon spring based compression to a launch a plastic bullet or the like.

U.S. Pat. No. 4,735,239 issued to Michael Salmon et al describes a liquid projecting device which is basically a bladder and a release trigger, the bladder being expanded by being filled up with water. Likewise, U.S. Pat. No. 4,854,480 issue to Robert Shindo describes a water gun with an expandable rubber tube or bladder which is filled with water and subsequently released by the trigger mechanism.

U.S. Pat. No. 4,892,081 Randall Moormann sets forth a compressable ball launcher which relies upon a telescoping cylindrical gun to compress air to force a ball out of a nozzle.

Notwithstanding the foregoing, the prior art neither teaches nor suggests the use of a safety mechanism for pressurized air toy gun nozzles to reduce the possibility of shooting hostile or dangerous projectiles therefrom, as in the present invention.

SUMMARY OF THE INVENTION

The present invention relates to a safety mechanism for an air gun having a nozzle with an inlet and an outlet and having pressurization capabilities and a release for releasing pressure through the nozzle, wherein the nozzle includes an impediment member (e.g. a launch tube) with which a mating projectile is fitted for shooting. The safety mechanism is located within the nozzle at the nozzle inlet, and prevents or inhibits shooting undesirable projectiles. The safety mechanism includes a valve connected to the nozzle to prevent flow of pressurized air into it when closed and to allow flow of pressurized air when opened; a biasing device for biasing the valve to a closed position; an opening device movably located within nozzle, e.g. within an annular space between a launch tube and the nozzle. This has a first position when a projectile is not located in the nozzle, corresponding to the valve being closed, and has a second position when a projectile is located in the nozzle, corresponding to the valve being opened. When the opening device is moved from its first position to its second position, the valve is moved from its closed position to its open position to permit the shooting of a projectile. The impediment member impedes the insertion and shooting of a non-mating object.

BRIEF DESCRIPTION OF THE DRAWINGS

The present invention is more fully understood when the present specification is taken in conjunction with the drawings appended hereto, wherein.

DETAILED DESCRIPTION OF THE PRESENT INVENTION

The present invention toy air gun has been developed to provide high powered, safe shooting of projectiles, such as foam darts. The toy air gun utilizing the safety mechanism of the present invention may be one which is pre-pressurized, e.g. via pump, with a tank or with a bladder, or may be a pre-loaded, cocking gun with a pressure creating spring-fired piston. In fact, it may be any known or yet to be developed air gun for shooting projectiles through a nozzle.

Figure 1:
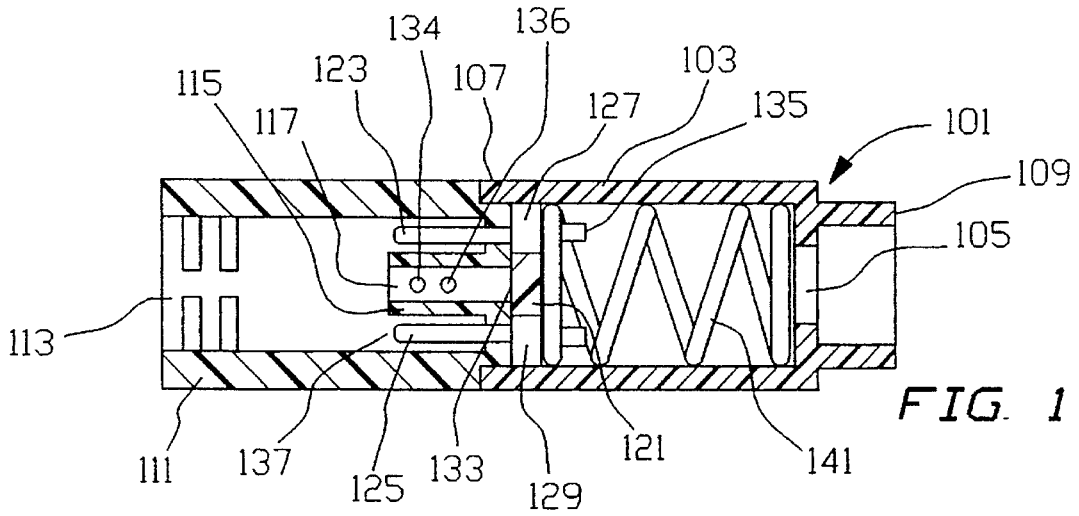
FIG. 1 shows a side cut view of a present invention safety mechanism for projectile shooting air guns.

FIG. 1 shows a present invention safety mechanism 101 which includes a nozzle formed of two portions, namely, a front portion 111 and a rear portion 103, as shown. There is an inlet 105 and an outlet 107 and fitting 109 for attachment to the barrel of an air gun. Impediment member, in this case launch tube 115, is designed to receive a mating projectile, i.e. a hollow projectile, and will prevent full length insertion of marbles and other undesirable objects and keep such objects from contacting the valve opening means discussed below. Launch tube 115 includes launch tube hollow inside 117, and launch tube inlet 133. Launch tube 115 and nozzle front portion 111 form annular space 137, enabling a hollow projectile (not shown, see FIG. 3 below) to be fitted thereon.

Figure 2:
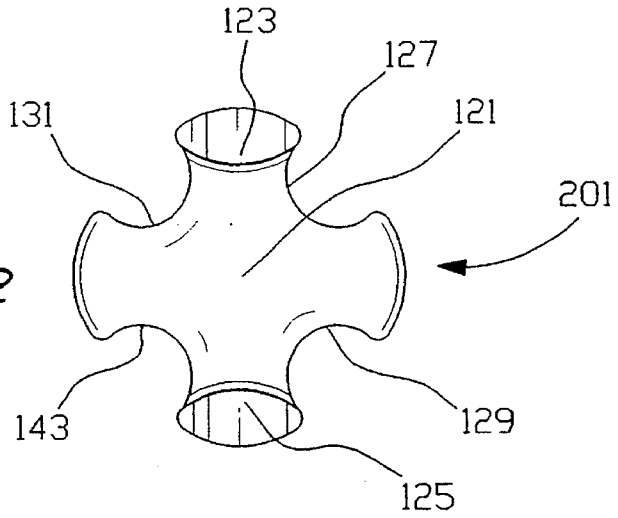
FIG. 2 shows a front view of a component of the mechanism shown in FIG. 1.

There is a valve 121 which has a first, closed position, as shown, and held by being biased by spring 141, held in place by legs such as leg 135. It also has a second, open position when valve 121 is moved to the right, via opening mechanisms 123 and 125 located within annular space 137, which are directly connected to valve 121, as shown. FIG. 2 shows opening mechanism 123 and 125 in a top view as valve and opening device 201. Device 201 includes air passage openings 127, 129, 131 and 143, valve 121 and mechanisms 123 and 125. As can be seen, either opening mechanism 123 or 125, or both may be and in most cases both will be pushed downwardly along with valve 121 against spring 141 when a hollow projectile is inserted into annular space 137, thereby opening valve 121 and allowing shooting, pressurized air to enter launch tube inlet 133. Thus, when the opening mechanisms are in their first, rest position, valve 121 closes inlet 133 and the base of front portion 111 shuts off air passage openings 127, 129, 131 and 143. They open when the opening mechanisms are pushed to the right to a second position when spring 141 is compressed. Also, launch tube 115 includes an optional, second, independent safety arrangement. There are air exit ports 134 and 136 which cause air to escape laterally when the opening mechanisms are pushed to the right, but the launch tube is not fully fitted by a hollow projectile.

Figure 3:
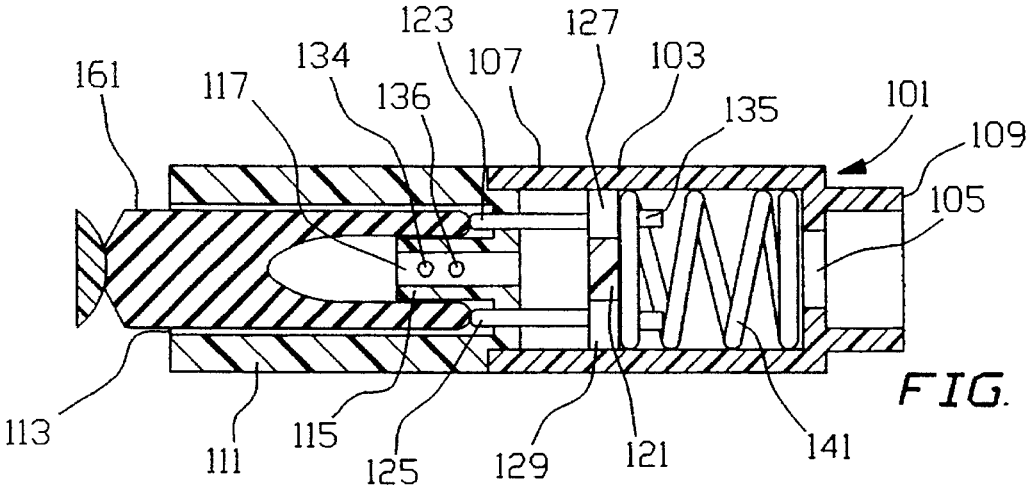
FIG. 3 shows the safety mechanism of FIG. 1 but in the loaded position.

FIG. 3 shows safety mechanism 101 of FIG. 1 in its ready to fire mode. Here, soft dart hollow projectile 161 has been inserted and is fitted over launch tube 115. Air exit ports 134 and 136 are sealed by the projectile 161, opening mechanisms 123 and 125 have been pushed to the right to open valve 121 and air passages such as passages 127 and 129 and, when fitted onto a gun via fitting 109, when the gun is fired, i.e. pressurized air released, the projectile 161 will be shot therefrom.

Figure 4:
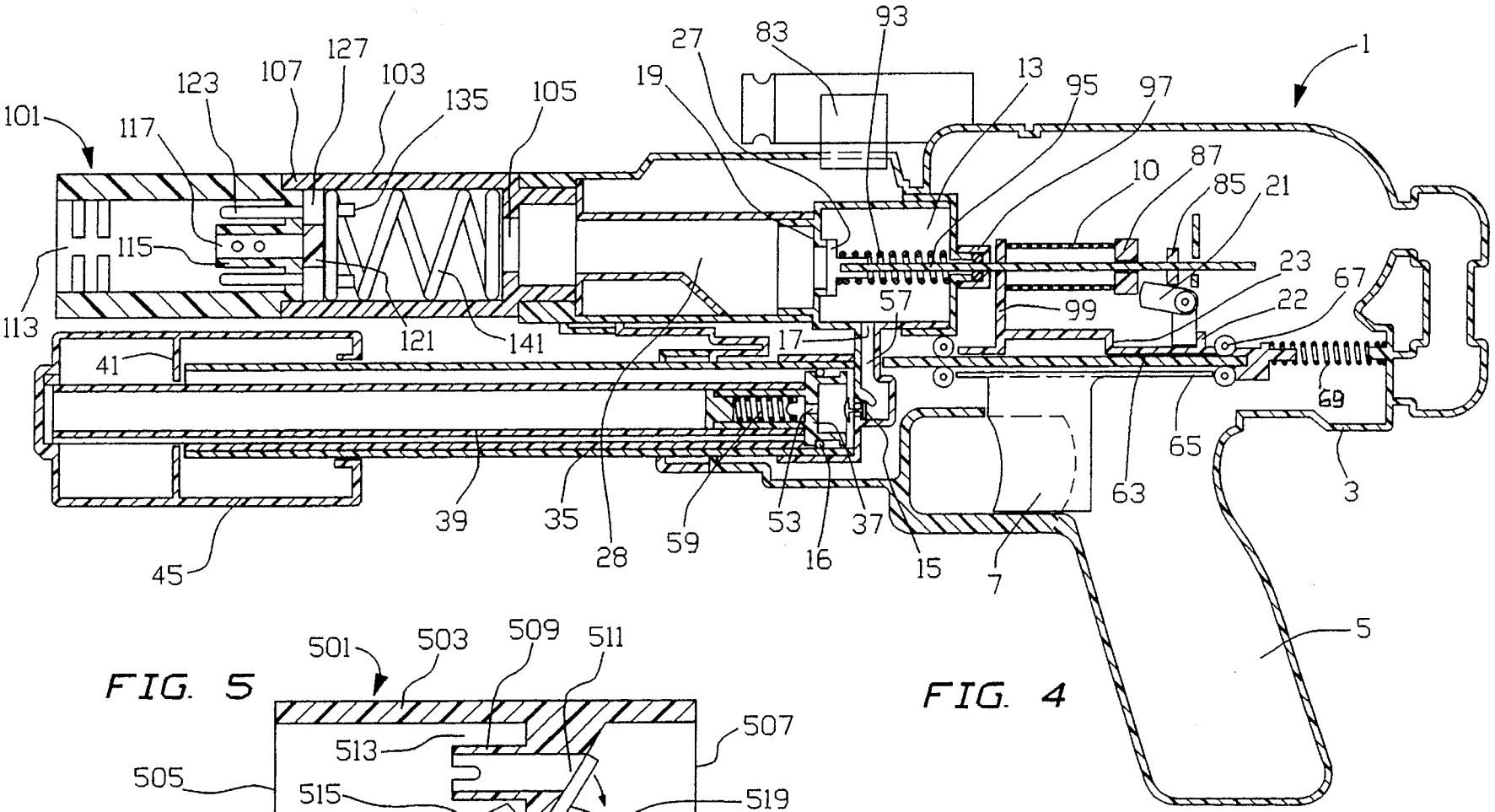
FIG. 4 shows a side cut view of an air pressurized, soft dart-shooting air gun with a present invention safety mechanism; and, FIG. 5 shows an alternative embodiment present invention safety mechanism.

Referring now to FIG. 4, the operation of a present invention safety mechanism embodiment can best be explained. FIG. 4 is a side view of a toy air gun 1 with main housing 3, handle 5, and trigger 7.

Pressurizable tank 13 is located within housing 3, as shown. Pressurizable tank 13 has inlet 17 and outlet 19 and is cylindrical, as shown. Inlet 17 has a one-way check valve 15 to prevent pressurized air from exiting through inlet 17.

Toy air gun 1 is operated by pressurizing the pressurizable tank 13 with air. Air is forced into the pressurizable tank 13 by the relative movement of the piston 37 within the air pump shaft 35. The piston 37 is operated by the pump rod 39 that connects the piston 37 to the slider handle 45. The pump rod 39 is anchored to the slider handle 45 via formed connector 41. The slider handle 45 is operated manually by the user. The user holds the slider handle 45 with one hand and the gun handle 5 with the other. The slider handle 45 is then moved back and forth The back and forth action is transferred to the piston 37, which forces air past a one way O-ring valve 16, when pulled out, and then, when pushed in, forces the air past valve 15, through a length of a tubing 57 and into the pressurizable tank 13. Air is continuously added to the pressurizable tank 13 via inlet 17 until a desired pressure is reached.

Once under pressure, the air in pressurizable tank 13 is prevented from flowing freely through the outlet 19 by valve 27. Safety release valve 53, with spring 59, prevents over pressurization. The strength of spring 59 in its biased configuration is calibrated so that when the pressure of air within the gun reaches a predetermined maximum value, the spring 59 will allow the valve 53 to be released until safe pressure is maintained.

Referring now back to pressurizable tank outlet valve 27, it has a first, closed position as shown. This is caused by the bias to that position from spring 93. Valve rod 95 is connected to valve 27 and passes through valve housing 97, hammer 87 and trigger riser 99. Spring 10 maintains riser 99 to the left. Spring 10 is in a static condition with no preload and is securely attached to riser 99 at one end and hammer 87 at the other end. Trigger pawl 21 is held in position by trigger rib 22. When the pressurizable tank 13 has been pressurized and a projectile such as projectile 161 is loaded, a user pulls trigger 7. This moves riser 99 to the right to compress spring 10; when ledge 23 hits the base of pawl 21, pawl 21 moves counter-clock-wise to release hammer 87 and compressed spring 10. Next, hammer 87 Hammers receiver 85, attached to rod 95, and instantly overcomes spring 93 and the internal pressure of valve 27, opens valve 27, provides a blast of pressure down tube 28 and into present invention safety mechanism 101, which has identical parts as shown in FIG. 1, with identical numbers. Launch tube 115 is closed via valve 121, except when a hollow dart is fitted thereon, as dart 161 shown in FIG. 3. When in place as shown in FIG. 3, the blast of air continues down launch tube 115 and launches a soft dart, such as dart 161 shown in FIG. 3. This results in a superior snap-action release, independent of trigger pull speed due to the accelerating hammer mechanism.

The safety mechanism 101 will thus prevent or inhibit undesirable shootings of marbles, hard rubber darts from older dart guns, plastic bullets, etc.

Seals with O-rings may be used to enhance pressure containment. Additionally, to stabilize trigger 7, a slide plate 63, attached to housing 3 sidewalls, receives trigger slider 65, connected to trigger 7. Rollers such as roller 67 add ease of motion and spring 69 biases trigger 7 to the closed position, as shown. Optional spare dart holder 83 may also be included, as shown.

Figure 5:
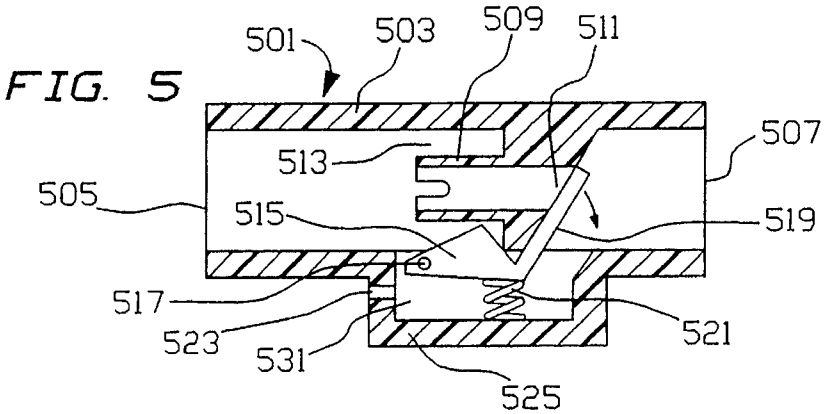

FIG. 5 shows an alternative embodiment wherein safety mechanism 501 includes nozzle 503, with outlet 505 and inlet 507, launch tube 509 and launch tube inlet 511. Launch tube 509 and nozzle 503 form annular space 513, enabling a hollow projectile (not shown) to be fitted thereon.

There is a valve 519 which has a first, closed position, as shown, and held by being biased by spring 521. There is an opening mechanism 515 located within annular space 513 connected to valve 519 and hinged to nozzle 503 via pin 517. As can be seen, opening mechanism 515, in this embodiment, is a triangular piece which will be pushed downwardly against spring 521 when a hollow projectile is inserted into annular space 513, thereby opening valve 519 and allowing shooting, pressurized air to enter inlet 511. There is also a side chamber 531 with air exit ports 523 and 525. Chamber 531 is open when valve 519 is closed (as shown) and valve 519 will close off chamber 531 when valve 519 is opened relative to inlet 511. This chamber thus acts as a release for pressure when valve 519 is closed, causing a user to repump to properly shoot a hollow projectile.

Obviously, numerous modifications and variations of the present invention are possible in light of the above teachings. For example, the impediment member may be a side plate projecting from the inside wall of the nozzle with a mating-cut projectile. Alternatively, it could be a solid center post, center plate, protruding wall peg, or other protrusion with a corresponding formed or cut projectile. It is therefore understood that within the scope of the appended claims, the invention may be practiced otherwise than as specifically described herein.

What is claimed is:

1. In an air gun having a nozzle with an inlet and an outlet and having means to create pressure and means for releasing pressure through said nozzle, wherein said nozzle includes a launch tube with which a mating projectile is fitted for shooting and, through which pressurized air is released, said launch tube being located within said nozzle, the improvement which comprises:

including within said nozzle at said nozzle inlet, a safety mechanism for reducing opportunities for release of pressure when said mating projectile is not fitted onto said launch tube, said safety mechanism including:

(a) a valve connected to said nozzle to prevent flow of pressurized air into said nozzle when said valve is in a closed position and to allow flow of pressurized air into said nozzle when said valve is in an opened position;

(b) a biasing means biasing said valve to said closed position; and, (c) opening means movably located within said nozzle and within proximity of said launch tube so as to have said opening means located in an upstream position from said launch tube within said nozzle, and having a first position when said mating projectile is not located in said nozzle, said first position corresponding to said valve being closed, said opening means being operably connected to said valve, and having a second position when said mating projectile is located in an annular space and mated to said launch tube, said second position corresponding to said valve being opened, wherein when said opening means is moved from its first position to its second position, said valve is moved from its closed position to its open position.

2. The safety mechanism of claim 1 wherein said launch tube has a predetermined length which is less than a predetermined length of said nozzle.

3. The safety mechanism of claim 2 wherein said biasing means is a spring.

4. The safety mechanism of claim 2 wherein said nozzle and said launch tube establish said annular space therebetween and said opening means is at least one protrusion extending from said valve to said annular space.

5. The safety mechanism of claim 4 wherein said biasing means is a spring.

6. The safety mechanism of claim 5 wherein said nozzle and said launch tube are connected to one another by an annular base having at least one orifice therethrough.

7. The safety mechanism of claim 4 wherein said nozzle and said launch tube are unistructurally formed.

8. The safety mechanism of claim 7 wherein said nozzle and said launch tube are connected to one another by an annular base having at least one orifice therethrough.

9. The safety mechanism of claim 4 wherein said nozzle and said launch tube are connected to one another by an annular base having at least one orifice therethrough.

10. The safety mechanism of claim 2 wherein said nozzle and said launch tube are unistructurally formed.

11. The safety mechanism of claim 2 wherein said nozzle and said launch tube are connected to one another by an annular base having at least one orifice therethrough.

12. The safety mechanism of claim 2 wherein said opening means includes a hinged lever within said nozzle and connected to said valve.

13. The safety mechanism of claim 2 wherein said launch tube has a cylindrical wall with at least one portion thereof being removed to create a secondary air escape route as a safety feature separate from and in addition to said safety mechanism.

14. The safety mechanism of claim 1 wherein said biasing means is a spring.

15. The safety mechanism of claim 1 wherein said opening means is at least one protrusion extending from said valve to said nozzle.

16. The safety mechanism of claim 15 wherein said biasing means is a spring.

17. The safety mechanism of claim 15 wherein said nozzle and said launch tube are unistructurally formed.

18. The safety mechanism of claim 1 wherein said nozzle and said launch tube are unistructurally formed.

19. The safety mechanism of claim 1 wherein said opening means includes a hinged lever with said nozzle and connected to said valve.

20. The safety mechanism of claim 1 wherein said launch tube has a cylindrical wall with at least one portion thereof being removed to create a secondary air escape route as a safety feature separate from and in addition to said safety mechanism.

* * * * *